US012320349B2

(12) United States Patent
Querrey et al.

(10) Patent No.: US 12,320,349 B2
(45) Date of Patent: Jun. 3, 2025

(54) FLUID SAMPLE PUMP SYSTEM

(71) Applicant: Mustang Sampling, LLC, Ravenswood, WV (US)

(72) Inventors: Timothy L. Querrey, Ravenswood, WV (US); William J. Hartson, Houston, TX (US)

(73) Assignee: Mustang Sampling, LLC, Ravenswood, WV (US)

( * ) Notice: Subject to any disclaimer, the term of this patent is extended or adjusted under 35 U.S.C. 154(b) by 377 days.

(21) Appl. No.: 17/903,163

(22) Filed: Sep. 6, 2022

(65) Prior Publication Data

US 2024/0077065 A1 Mar. 7, 2024

(51) Int. Cl.
*F04B 9/127* (2006.01)
*F04B 39/02* (2006.01)
*F04B 53/10* (2006.01)

(52) U.S. Cl.
CPC ..... *F04B 9/127* (2013.01); *F04B 39/0276* (2013.01); *F04B 39/0292* (2013.01); *F04B 53/10* (2013.01)

(58) Field of Classification Search
CPC ..... F04B 9/127; F04B 9/1276; F04B 9/1215; F04B 2015/081; F04B 19/22; F04B 15/08–081; F04B 39/0292; F04B 39/0276; G01N 2001/1427
USPC ..... 73/64.56
See application file for complete search history.

(56) References Cited

U.S. PATENT DOCUMENTS 2,467,413 A * 4/1949 Wildhack ..... F04B 9/127 62/50.3
2,588,164 A * 3/1952 D Haem ..... F04B 9/127 91/335
2,987,047 A * 6/1961 Young ..... F15B 21/10 91/395
3,299,827 A * 1/1967 Ferrari ..... F04B 9/127 417/317
3,782,247 A * 1/1974 Klaeger ..... F01B 17/02 91/321
3,945,465 A 3/1976 Vander Horst et al.
5,092,745 A * 3/1992 Graham ..... F04B 9/127 417/387
6,663,360 B1 * 12/2003 Kyer ..... F02M 59/107 417/399
7,637,977 B2 12/2009 Lucidera
(Continued)

FOREIGN PATENT DOCUMENTS

CN 2856477 Y * 1/2007 ..... F04B 9/127

OTHER PUBLICATIONS

Mustang Sampling LLC, Mustang Liquid Sample Pump, Dec. 2017, pp. 1-2, vol. 1.1, Mustang Sampling, Mustang and Analytically Accurate Technology, Ravenswood, WV.
(Continued)

*Primary Examiner* — Thomas Fink
(74) *Attorney, Agent, or Firm* — Cahn & Samuels, LLP

(57) ABSTRACT

An improved fluid sample pump with the combination of an in-line pressure relief valve, an in-line, synthetic lubrication oiler associated with an air-actuation port, a stainless steel actuator housing with a centered air-actuation input port and a friction-reducing, anticorrosive coating on the interior thereof, an actuator piston with polyurethane O-rings, a shot-peened, zinc-coated music wire compression coil actuator piston return spring.

7 Claims, 2 Drawing Sheets

(56) References Cited

U.S. PATENT DOCUMENTS

| | | | | |
|---|---|---|---|---|
| 2005/0257631 | A1 | 11/2005 | Mayeaux | |
| 2015/0198157 | A1* | 7/2015 | Klentzman ..... | F04B 13/00 417/430 |
| 2015/0315908 | A1 | 11/2015 | Garcia et al. | |
| 2021/0063285 | A1 | 3/2021 | Thompson et al. | |

OTHER PUBLICATIONS

Mustang Sampling LLC, Mustang Liquid Sample Pump, Jan. 2020, pp. 1-2, Mustang Sampling, Mustang and Analytically Accurate Technology, Ravenswood, WV.

PGI International, Installation Operation Maintenance Manual: Nova "P" Series Sampling System, Nov. 2003, op. 1-89, PGI International, Houston, TX.

Synco, Compatibility Chart: Super Lube O-Ring Silicone Lubricant, pp. 1-1, Synco Chemical Corporation, Bohemia, NY.

Grainger, Wilkerson Filter/ Regulator/Lubricator: 3/8 in NPT, 68 cfm, 250 psi Mx Op Pressure, 5 micron, pp. 1-3, Grainger, China.

U.S. International Searching Authority International Search Report for Application No. PCT/US2022/044546, Dec. 28, 2022.

U.S. International Searching Authority International Written Opinion for Application No. PCT/US2022/044546, Dec. 28, 2022.

* cited by examiner

FLUID SAMPLE PUMP SYSTEM

FIELD OF INVENTION

This invention relates to a pneumatically-actuated fluid sample piston pump system assembly particularly for use with natural gas liquids (NGL) and cryogenic NGL, and vaporized gases containing the same, with improved performance using a combination of elements including an in-line Filter-Regulator-Lubricator (FRL) synthetic lubrication oiler associated with the pressurized actuation gas/air input for lubricating the pump piston actuator, at least one in-line pressure relief valve for over-pressure protection, and a centered, air-actuation port, an actuator piston with polyurethane O-rings, a shot-peened, zinc-coated Music Wire compression coil actuator piston return spring, a stainless steel actuator housing and a friction-reducing, anti-corrosive coating, and a pressurized fluid flow meter valve.

BACKGROUND OF THE INVENTION

In natural gas sample processing and particularly NGL or cryogenic NGL, small liquid aliquots are extracted from a source, pressurized by a pump, and passed to a sample collector. In such processing, it is critical to maintain the fluid in a steady state, whether in vapor or in liquid form to prevent phase changes causing sampling irregularities. To that end, it is desirable, particularly in the case of low temperature processing, e.g. −65° F. (−54° C.) to minimize the presence of phase-change inducing heat in the pumping process.

SUMMARY OF THE INVENTION

It is an object of the improved fluid sample take-off pump of this invention to significantly reduce, if not eliminate, heat generation by the pump while providing enhanced operational reliability.

It is another object of the invention to provide a combination of features that reduce the need for pumping interruptions resulting from part replacements.

A further object of the invention is to maximize duty cycle and operational longevity in the field while minimizing maintenance and replacement of moving parts and or the entire pump assembly.

Still another object of the invention is to provide a pneumatically actuated sample pump operable to permit continuous, uninterrupted, fixed-volume sample extraction from a significant source (tanker ship, railroad tank car, pipeline, etc.).

A further object of the invention is to eliminate the need for a pneumatic input calibrator by relying on process control timing of an associated Programmable Logic Controller (PLC) to obtain standard fixed sample volumes (e.g., 3 cc per stroke).

These and other objects are satisfied by an improved pneumatically actuated piston fluid sample pump operable at a range of temperatures compatible with natural gas liquid (NGL) and cryogenic NGL sampling operational environments in either a vaporized or liquid phase with a pressurized actuation gas, a pressurized actuation gas inlet port, a sample take-off input and a pressurized fluid sample output, comprising; an in-line oiler for providing a controlled dropwise introduction of synthetic lubricating oil into the pressurized actuation gas; an in-line pressure relief valve associated with and disposed downstream of the in-line oiler; a stainless-steel piston actuator housing including an upper wall with a centered inlet port for the pressurized actuation gas, an interior piston head chamber of a first select diameter having an interior surface with a non-reactive, anti-corrosive, friction reduction coating, and a lower wall; an actuating piston including a piston head having a diameter corresponding to the first select diameter for reciprocation in the piston head chamber, a connecting piston rod, and a piston plunger cylinder of a second select diameter connected to the piston rod; a zinc-coated, shot peened Music Wire coiled piston return compression spring seated in the piston head chamber between the piston head and the lower wall; an elongated stainless-steel piston plunger cylinder housing affixed to and projecting from the lower wall of the stainless-steel piston actuator housing, the stainless-steel piston plunger cylinder housing having an interior surface with a non-reactive, anti-corrosive, friction reduction coating corresponding to the second select diameter; a plurality of spaced, polyurethane O-rings corresponding to the second select diameter disposed on the piston plunger; a fluid sample input to the stainless-steel piston plunger cylinder housing; a pressurized fluid sample output; and a flow metering valve with an integrated by-pass disposed in-line with the pressurized fluid sample output.

A unit consisting of a filter regulator and lubricator (FRL) is used where the compressed actuating air not only needs to be cleaned but also oiled. The filter regulator removes the condensate and coarse dirt from the compressor. The lubricator periodically supplies precisely dosed amounts of lubricating oil possessing substantially stable low viscosity at the range of temperatures to the actuating air prior to introduction into the pump housing interior surface to minimize frictional heat generation resulting from reciprocation of the piston.

Other objects of the invention are provided by a system that facilitates improved, continuous, uninterrupted operation of a pneumatically-actuated fluid sample pump assembly by combining an air input line pressure relief valve, an air input in-line synthetic oil oiler, a centered air-input to the pump piston head chamber that includes a friction reducing, anti-corrosion coating, a reciprocating piston plunger cylinder incorporating polyurethane sealing O-rings to reduce thermal stress cause by heat generation during operation, a heat dissipating stainless steel actuator housing and piston plunger cylinder housing, a shot-peened, zinc-coated Music Wire piston return spring, and an in-line flow metering valve associated with the pressurized fluid output.

By locating the pneumatic input centrally, the arrangement promotes uniform pressurization on the actuating piston head and reduces uneven torquing forces on the piston attributable to off-centered air input. The invention also dispenses with the need for a pressure releasing bursting disk integrated with the actuator housing. The elimination of the bursting disk obviates with the need for pump disassembly to replace a burst disk resulting from over-pressurization and thereby decreases operational down time and labor required for such repair.

In the following description, reference is made to the accompanying drawing, and which is shown by way of illustration to a specific embodiment in which the invention may be practiced. The following illustrated embodiment is described in sufficient detail to enable those skilled in the art to practice the invention. It is to be understood that other embodiments may be utilized and that structural changes based on presently known structural and/or functional equivalents may be made without departing from the scope of the invention.

DETAILED DESCRIPTION

Figure 1:
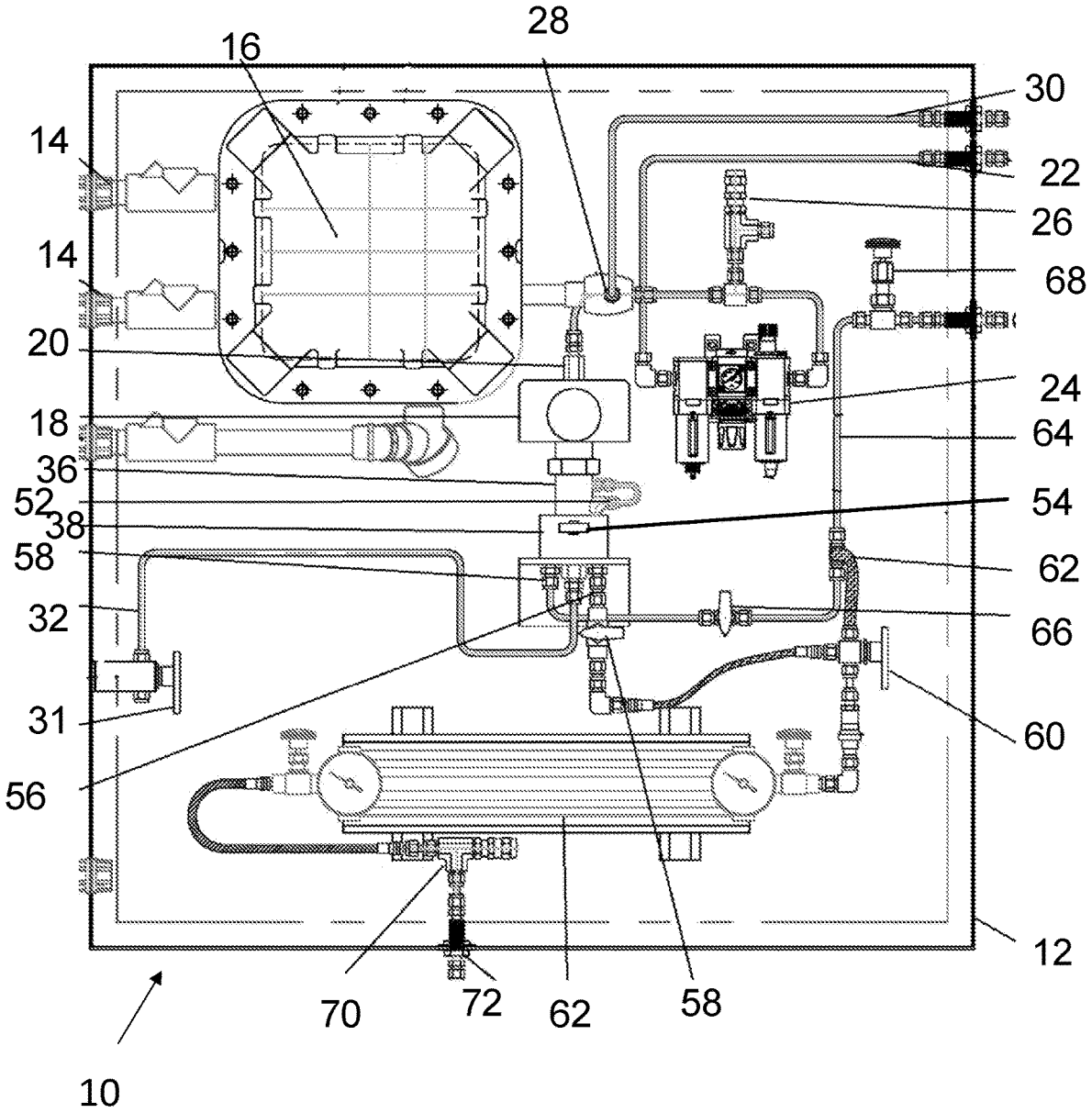
FIG. 1 is a schematic view of an embodiment of a pneumatically-actuated fluid sample pump system according to the invention.

The invention comprises an improvement to the current Mustang Liquid Sample Pump. The improved sample pump is applicable for sample collection during transfer operations of a fluid (either in a vapor or a liquid phase) and is particularly suited for continuous operation and use in harsh ambient environments even with cryogenic liquid sample collection. The following description first addresses the pneumatic pump actuating elements followed by the sample pressurization elements.

The assembly 10 includes a cabinet-type housing 12 incorporating appropriate electrical power feeds 14 for an associated Programmable Logic Controller (PLC) 16. A feedthrough in the cabinet 12 provides pressurized actuating instrument air/gas inlet line 22 which feeds pressurized instrument air to and through the in-line Filter/Regulator/Lubricator (FRL) unit 24. The FRL unit filters the pressurized instrument air, regulates the flow and pressure of the same, and injects a synthetic lubricant into the instrument air stream. The oiler is automatically controlled to periodically introduce a drop of synthetic oil into the instrument air stream before introduction of the pressurized air into the downstream piston chamber to ensure the presence of lubricant in the piston chamber during pump operation.

Filter/Regulator/Lubricator (FRL) units are well known devices as described in U.S. Pat. Nos. 3,945,465 and 7,637,977. An example of a FRL suitable for use in connection with the illustrated embodiment is available from Grainger as the Wilkerson Model C18-03-FLG0B. The FRL unit 24, in this embodiment, injects a thermally stable, non-reactive, low-viscosity lubricant to prevent damage from abrasion, limits heat generation to avoid partitioning/phase-change of the sample fluid and resulting compositional anomalies thereof during input and output from the pump during operation, and protects and lubricates the below described piston pump plunger O-Rings by filling any surface irregularities that may develop during operation. The injected lubricant maintains a friction-minimizing, smooth, surface and avoids damage from abrasion, pinching or cutting while promoting proper seating of the O-rings on the piston. One such lubricant is a non-curing silicone from Synco Chemical Company of Bohemia, New York sold under the name Super Lube® O-Ring Silicone Lubricant. Use of the lubricant also enhances consistent pump operation performance at temperatures ranging from ambient to as low as −65° F. (−54° C.) associated with Natural Gas Liquid (NGL) or cryogenic NGL fluid and processing (whether in liquid or vapor form).

Following passage through the FRL, the air stream passes through an in-line pressure relief valve 26 and a three-way solenoid valve 28 controlled by the PLC 16 providing and outlet for over-pressurized air before introduction to the input/output 20. The solenoid valve 28 is connected with an instrument air relief bypass line 30 that also provides an exhaust for air outputted from the pump 18.

Figure 2:
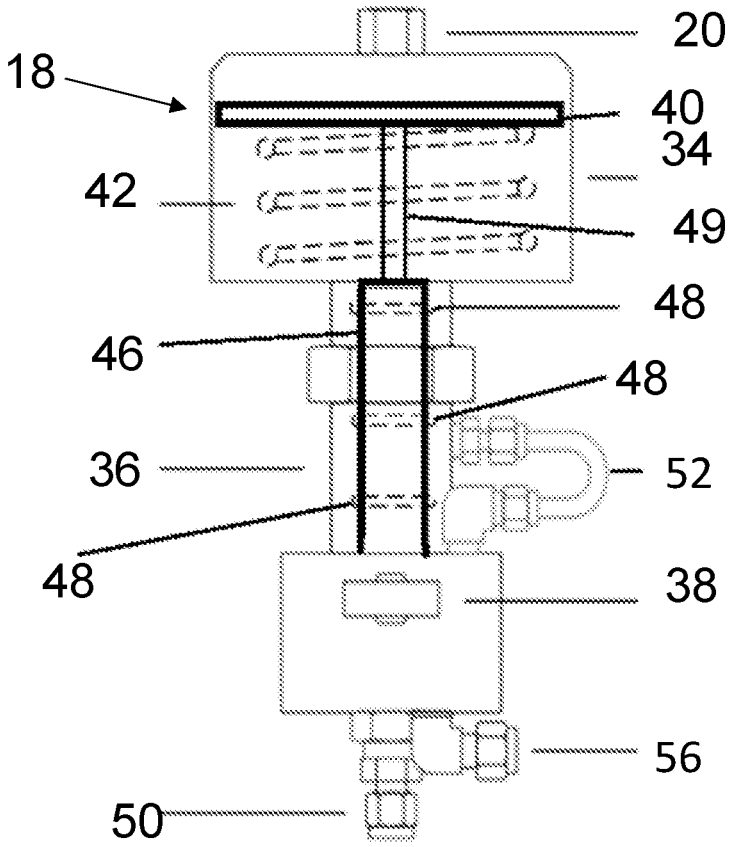
FIG. 2 is a schematic view of the fluid sample pump of FIG. 1.

The fluid sample pressurizing assembly includes a fluid sample input line 32 including a shut-off valve 31 that feeds to the pump 18. The pump 18, as illustrated in more detail in FIG. 2, includes an interiorly protective coated, stainless steel actuator housing 34, an interiorly protective coated, cylindrical piston plunger chamber 36, and is secured to a pump sample outlet and bypass manifold 38. The actuator housing 34 includes the centrally disposed actuating air input/output 20 in its upper wall, a reciprocating piston head 40, a piston return spring 42, an underlying cylindrical piston reciprocation channel, dimensionally conforming to an actuating piston body 46. The piston head 40 is rigidly affixed to the piston plunger body 46 via connecting rod 49 and the piston plunger body 46 includes a plurality of axially-spaced O-rings 48 that enhance abrasion resistance and provide a broadened thermal operability range, e.g., as low as −65° F. (−54° C.). The O-rings are disposed on the outer circumferential surface are to seal against fluid leakage.

The interior surfaces of the actuator housing and the cylindrical piston reciprocation channel include a coating against oxidation, corrosion, and friction to improve the duty-cycle life of the piston actuator and actuator spring. One such coating is Dursan®, a proprietary, low surface energy, coating from SilcoTek Corporation of Belfont, Pennsylvania that is bonded to the interior wear surfaces of the movable piston pump parts by vapor deposition to reduce heat energy generation during repeated reciprocation of the piston and O-rings in the housing and cyclical compression/decompression of the actuator spring.

The piston return spring 42 is composed of a high-carbon steel Music Wire which possesses a higher tensile strength than stainless steel and an ability to operate effectively at a greater temperature range and even at higher temperatures, e.g., 250° F. (121° C.). In addition, the Music Wire is shot peened to enhance cycle-life and reduce replacement requirements. The shot peening process entails impacting small beads/shots to deform the Music Wire surface and thereby increase the spring strength from hardening and relieve residual stresses at the surface. Following the shot peening process, the Music Wire spring is zinc plated to enhance corrosion resistance and reduce heat generation by providing the spring with a bright reflective finish. The dimensions and compressed length of the shot peened, zinc-coated Music Wire remain essentially unchanged relative to a conventional spring and allows for enhanced operational continuity resulting from significantly more compressions before requiring replacement from spring fatigue/failure. In one test, the compression spring was subject to cycling for 420 hours in a laboratory at ambient temperature (80° F./26° C.) for a total of four work weeks. Testing without spring failure was nonstop (Monday AM through Friday PM), providing the equivalent of sampling operations for 189,000 3 cc/ml samples.

Turning now to the flow of the fluid sample through the pump assembly, the fluid enters the pump from input line 32 via pump inlet 50 and into the pump chamber 36. This occurs when the actuating air pressure in the actuator housing 34 is released by timing control of the PLC 16 to open the solenoid valve 28 to flow back through the single input/output 20 to exhaust through the air relief line 30 and allow for the spring 42 to decompress. In the next pressurizing cycle, the pressurized instrument air is introduced via the centered input/output 20 to apply even pressure across the piston head 40 to move the piston body 46 in the cylindrical piston reciprocation channel to pressurize the sample fluid. The then pressurized sample fluid exits the chamber through the pressurized fluid sample loop 52 and into the pump outlet/bypass manifold 38 which includes a manually operated three-way valve 54 that will redirect flow from pressurized fluid outlet 56 to bypass outlet 58 at system start-up or for repair.

Likewise, in-line and downstream of the pressurized fluid outlet 56 is a manually actuated two-way shut-off valve 58 to terminate pressurized fluid flow from the outlet to a further manually operated three-way valve 60. During ordinary sample collection, the valve 60 directs pressurized fluid flow to a sample collection cylinder 62. When disconnection of the collection cylinder 62 is desirable (when full, during start-up operations, or when an over-pressure situation is detected) the valve 60 is rotated to redirect the pressurized fluid sample through by-pass 62 and into the line 64 connected to the by-pass outlet 58. A further manually actuated two-way valve is disposed in-line between the pump's by-pass outlet 58 and the junction of by-pass 62 to allow for selective isolation of the respective lines. A valved by-pass port 68 is disposed downstream of the by-pass 62 for exhausting any pressurized gas in the by-pass arrangement from the cabinet 12.

Optionally, a second pressure relief valve 70 may be included at the downstream side of the collection cylinder 62 with a direct exhaust outlet 72 through the cabinet 12 to prevent over-pressurization of the cylinder sample content.

Although only a single embodiment of the invention has been illustrated in the forgoing specification, it is understood by those skilled in the art that many modifications and embodiments of the invention will come to mind to which the invention pertains, having benefit of the teaching presented in the foregoing description and associated drawing. It is therefore understood that the invention is not limited to the specific embodiment disclosed herein, and that many modifications and other embodiments of the invention are intended to be included within the scope of the invention. Moreover, although specific terms are employed herein, they are used only in generic and descriptive sense, and not for the purposes of limiting the description invention.

We claim:

1. An improved pneumatically actuated piston fluid sample pump operable at a range of temperatures compatible with natural gas liquids (NGL) and cryogenic NGL sampling operational environments in either a vaporized or liquid phase with a pressurized actuation gas, a pressurized actuation gas inlet port, a sample take-off input and a pressurized fluid sample output, comprising:

an in-line oiler for providing controlled drop-wise introduction of synthetic lubricating oil into the pressurized actuation gas;

an in-line pressure relief valve associated with the pressurized actuation inlet port disposed downstream of the in-line oiler;

a stainless-steel piston actuator housing including an upper wall with a centered inlet port for the pressurized actuation gas, an interior piston head chamber of a first select diameter having an interior surface with a non-reactive, anti-corrosive, friction reduction coating, and a lower wall;

an actuating piston including a piston head having a diameter corresponding to the first select diameter for reciprocation in the piston head chamber, a connecting piston rod, and a piston plunger cylinder of a second select diameter connected to the piston rod;

a zinc-coated, shot peened Music Wire coiled piston return compression spring seated in the piston head chamber between the piston head and the lower wall;

an elongated stainless-steel piston plunger cylinder housing affixed to and projecting from the lower wall of the stainless-steel piston actuator housing, the stainless-steel piston plunger cylinder housing having an interior surface with a non-reactive, anti-corrosive friction reduction coating corresponding to the second select diameter;

a plurality of spaced, polyurethane O-rings corresponding to the second select diameter disposed on the piston plunger;

a fluid sample input to the stainless-steel piston plunger cylinder housing;

a pressurized fluid sample output; and a flow metering valve with an integrated by-pass disposed in-line with the pressurized fluid sample output.

2. The improved pneumatically actuated piston fluid sample pump of claim 1 where the in-line oiler is controlled by a PLC.

3. The improved pneumatically actuated piston fluid sample pump of claim 1 where the in-line oiler includes a filter and pressure regulator.

4. The improved pneumatically actuated piston fluid sample pump of claim 1 further comprising a sample collection cylinder connected to the pressurized fluid sample output, and a pressure relief valve to prevent over-pressurization of the sample collection cylinder.

5. A system that facilitates improved, continuous, uninterrupted operation of a pneumatically-actuated fluid fixed-volume sample pump assembly comprising in combination;

an air input line pressure relief valve, an air input in-line oiler, a stainless steel actuator housing, a centered air-input to a pump piston head chamber with a friction reducing, anti-corrosion coating, a shot-peened, zinc-coated Music Wire piston head return spring, a piston plunger cylinder housing disposed below the actuator housing dimensioned to correspond to a piston plunger cylinder for cyclical reciprocation therein, the piston plunger cylinder incorporating a plurality of polyurethane sealing O-rings, and an in-line flow metering valve associated with a pressurized fluid output.

6. The improved sample pump of claim 5 where the piston plunger cylinder includes two spaced, polyurethane sealing O-rings.

7. The improved sample pump of claim 5 where the in-line oiler is controlled by a PLC to periodically introduce synthetic lubricant into the instrument air introduced to the pump piston head chamber tor housing through the pneumatic input port.

* * * * *